US007762768B2

(12) United States Patent
Shi et al.

(10) Patent No.: US 7,762,768 B2
(45) Date of Patent: Jul. 27, 2010

(54) MECHANICAL SUPPORT OF A CERAMIC GAS TURBINE VANE RING

(75) Inventors: Jun Shi, Glastonbury, CT (US); Kevin E. Green, Broad Brook, CT (US); Daniel A. Mosher, Glastonbury, CT (US); John E. Holowczak, South Windsor, CT (US); Gregory E. Reinhardt, South Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 698 days.

(21) Appl. No.: 11/598,450

(22) Filed: Nov. 13, 2006

(65) Prior Publication Data

US 2008/0112803 A1 May 15, 2008

(51) Int. Cl.
*F01D 9/00* (2006.01)

(52) U.S. Cl. ..... 415/209.3

(58) Field of Classification Search ..... 415/209.3, 415/209.2, 209.4; 416/206, 208, 209, 212 A, 416/204 A See application file for complete search history.

(56) References Cited

U.S. PATENT DOCUMENTS 5,431,541 A 7/1995 Shaffer
6,200,092 B1 3/2001 Koschier
7,094,025 B2 * 8/2006 Arness et al. ..... 415/189
7,300,246 B2 * 11/2007 Durocher et al. ..... 415/191

OTHER PUBLICATIONS

Jun Shi, Venkata R. Vedula, John Holowczak, Connie E. Bird, S. Scott Ochs, Luca Bertuccioli and David J. Bombara, Preliminary Design of Ceramic Components for the ST5+ Advanced Microturbine Engine, Proceedings of: ASME TURBOEXPO 2002, Jun. 3-6, 2002, Amsterdam, The Netherlands, pp. 1-6.

Bill Tredway, Jun Shi, John Holowczak, Venkata Vedula, Connie E. Bird, S. Scott Ochs, Luca Bertuccioli, David J. Bombara and Kevin E. Green, Design of Ceramic Components for an Advanced Microturbine Engine, Proceedings of: ASME TURBOEXPO 2004, Vienna, Austria, pp. 1-6.

* cited by examiner

*Primary Examiner*—Edward Look
*Assistant Examiner*—Dwayne J White
(74) *Attorney, Agent, or Firm*—Kinney & Lange, P.A.

(57) ABSTRACT

An assembly for mounting a ceramic turbine vane ring onto a turbine support casing comprises a first metal clamping ring and a second metal clamping ring. The first metal clamping ring is configured to engage with a first side of a tab member of the ceramic turbine vane ring. The second metal clamping ring is configured to engage with a second side of the tab member such that the tab member is disposed between the first and second metal clamping rings.

22 Claims, 11 Drawing Sheets

MECHANICAL SUPPORT OF A CERAMIC GAS TURBINE VANE RING

STATEMENT REGARDING FEDERALLY SPONSORED RESEARCH OR DEVELOPMENT

This invention was made with Government support under DE-FC26-00CH11060 awarded by the United States Department of Energy. The Government has certain rights in this invention.

BACKGROUND OF THE INVENTION

The present invention relates generally to gas turbine engines. More particularly, the present invention relates to the mechanical support of a ceramic gas turbine vane ring.

A gas turbine engine consists of an inlet, a compressor, a combustor, a turbine, and an exhaust duct. The compressor draws in ambient air and increases its temperature and pressure. Fuel is added to the compressed air in the combustor to raise gas temperature, thereby imparting energy to the gas stream.

To increase gas turbine engine efficiency, it is desirable to increase turbine inlet temperature. This requires the first stage turbine vanes and rotor blades to be able to withstand the thermal and oxidation conditions of the high temperature combustion gas. While individual ceramic vanes have been the primary focus in the past, ceramic integral vane ring design has gathered momentum for small gas turbines due to advances in ceramic component manufacturing and to requirements for low cost and reliable components.

Although ceramic materials have excellent high temperature strengths, their coefficients of thermal expansion (CTE) are much lower than those of metals, which are commonly used in components that support ceramic vane rings. Additionally, ceramic materials are highly susceptible to localized contact stress due to their brittleness (i.e., inability to deform sufficiently to reduce contact pressure before fracture). Therefore, attachment design of ceramic components requires extra care to take into account these unique characteristics of ceramic materials.

Thus, there exists a need for an assembly capable of supporting a ceramic vane ring while minimizing the possibility of damaging the ceramic vane ring during repeated thermal expansion cycles.

BRIEF SUMMARY OF THE INVENTION

The present invention is an assembly for mounting a ceramic turbine vane ring onto a turbine support casing. The assembly comprises a first metal clamping ring and a second metal clamping ring. The first metal clamping ring is configured to engage with a first side of a tab member of the ceramic turbine vane ring. The second metal clamping ring is configured to engage with a second side of the tab member such that the tab member is disposed between the first and second metal clamping rings.

DETAILED DESCRIPTION

Figure 1:
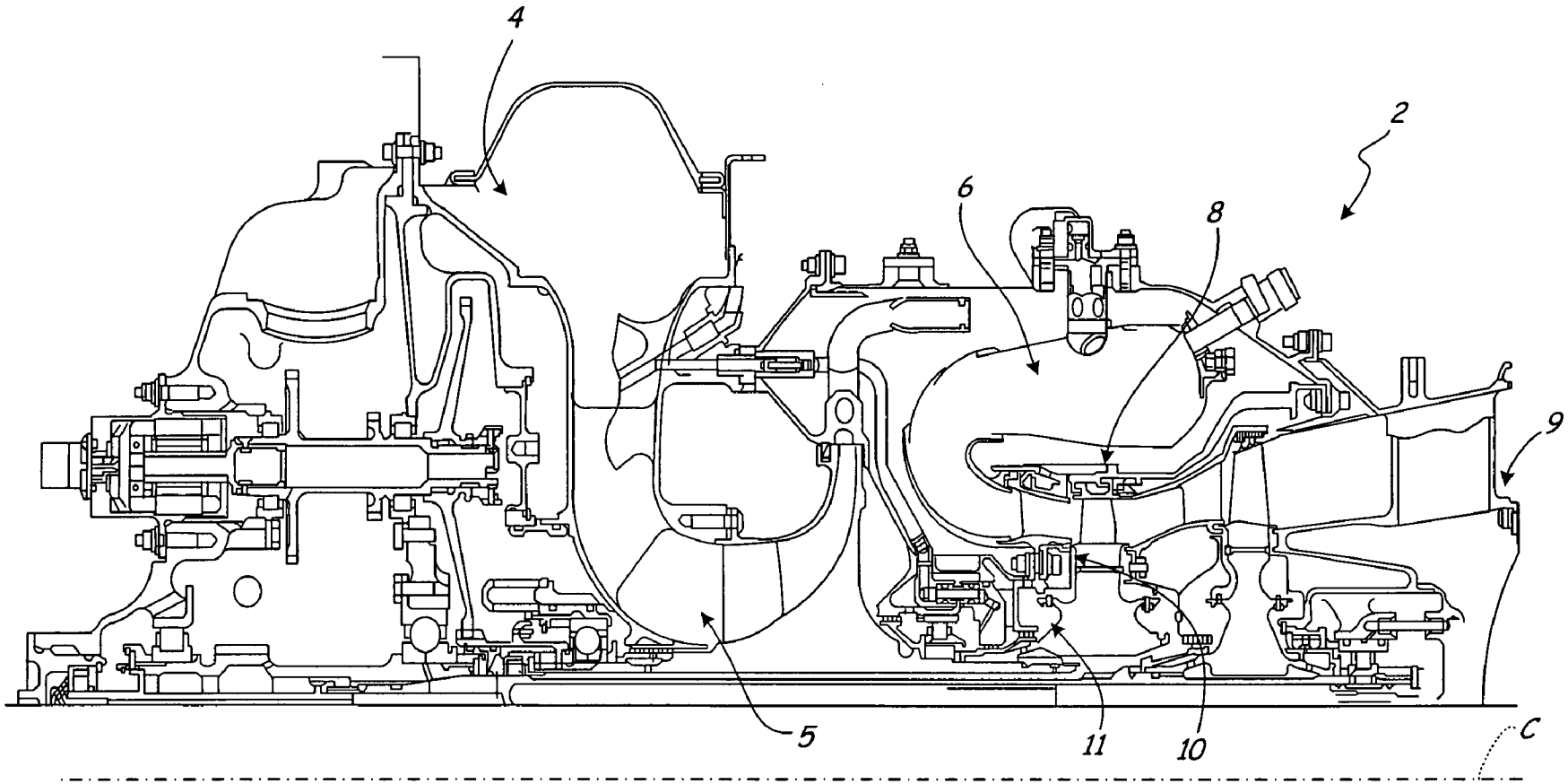
FIG. 1 is a cross-sectional view of a top half of a gas turbine engine assembly.

FIG. 1 is a cross-sectional view of a top half of an aircraft gas turbine engine 2 above engine centerline C, which includes inlet 4, compressor section 5, combustor section 6, turbine section 8, and outlet 9. Turbine section 8 includes ceramic vane ring assembly 10 and turbine support casing 11, which is designed to support and position ceramic vane ring assembly 10 within turbine engine 2. In general, compressor section 5 draws in ambient air through inlet 4 and increases its temperature and pressure. The air is then diverted toward combustor section 6 where fuel is added to the compressed air to raise the temperature of the air, thereby imparting energy into the stream of air. This high temperature gas is then expanded in turbine section 8 to extract work from the gas that is used to drive compressor section 5 as well as other mechanical devices. The gas stream is then expanded to ambient temperature and discharged from gas turbine engine 2, thereby producing a high velocity thrust for use as a propulsion force.

Figure 2:
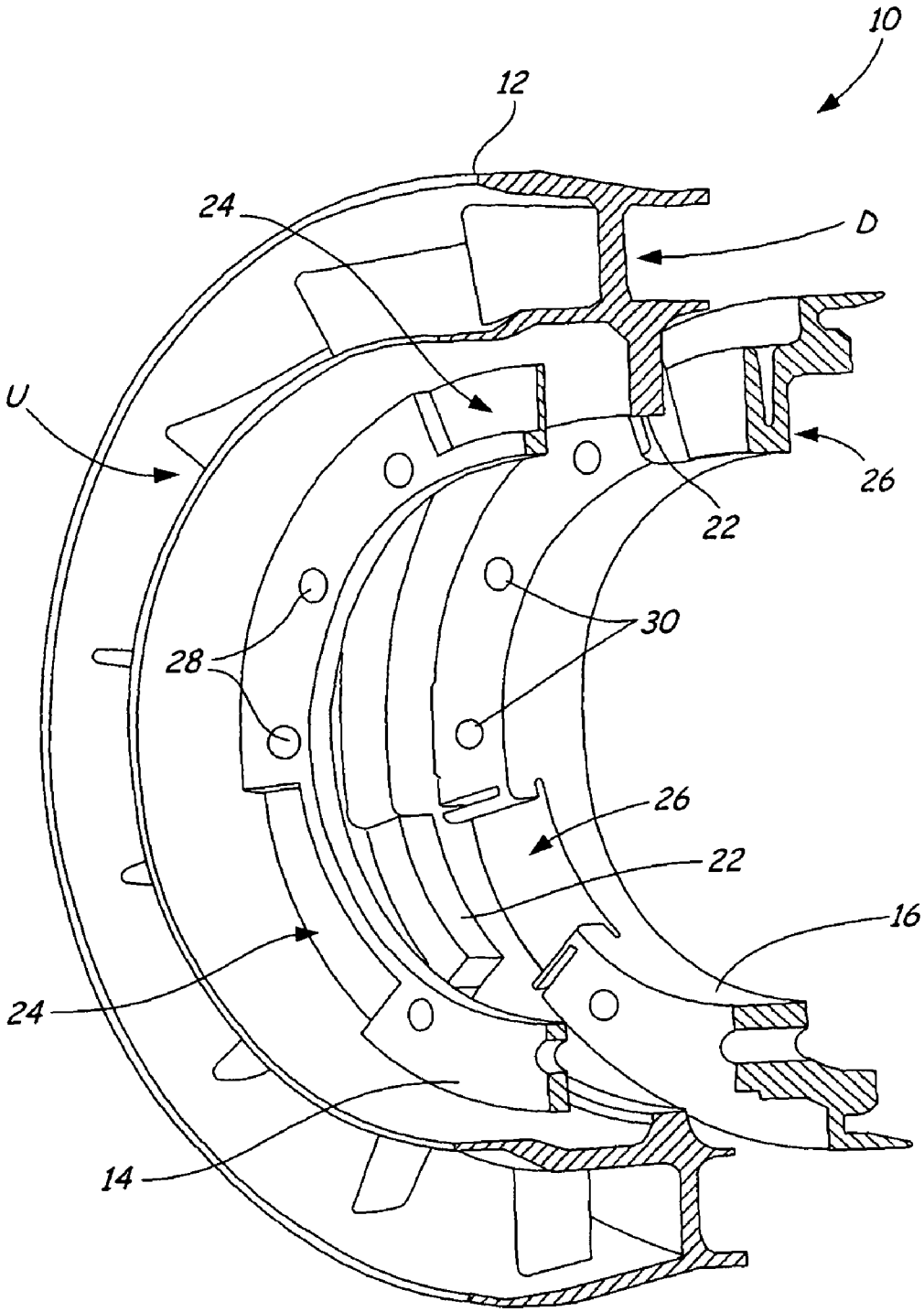
FIG. 2 is a sectional perspective view of a ceramic vane ring assembly according to the present invention, which includes a ceramic vane ring, a first metal clamping ring, and a second metal clamping ring.

FIG. 2 is a sectional perspective view of ceramic vane ring assembly 10, which includes ceramic vane ring 12, first metal clamping ring 14, and second metal clamping ring 16. First clamping ring 14 is configured to support an upstream side U of ceramic vane ring 12, while second clamping ring 16 is configured to support a downstream side D of ceramic vane ring 12.

As shown in FIG. 2, ceramic vane ring 12 includes one or more tab members 22. First clamping ring 14 and second clamping ring 16 each include a number of spring members 24 and 26, respectively, equal to the number of tab members 22. Each tab member 22 is configured to mate with a spring member 24 on the upstream side U of ceramic vane ring 12 and a spring member 26 on the downstream side D of ceramic vane ring 12. Spring members 24 and 26 are preferably sized such that they are sufficiently compliant so that no excessive forces are placed upon tab members 22. These forces may result from, for example, temperature gradients causing material expansion or dimensional tolerances.

First clamping ring 14 and second clamping ring 16 include a plurality of apertures 28 and 30, respectively. Apertures 28 and 30 are configured to receive a fastening means (not shown) to fasten first and second clamping rings 14 and 16 together to secure ceramic vane ring 12 in between the clamping rings. The fastening means may include bolts, rivets, or other means known in the art.

Figure 3:
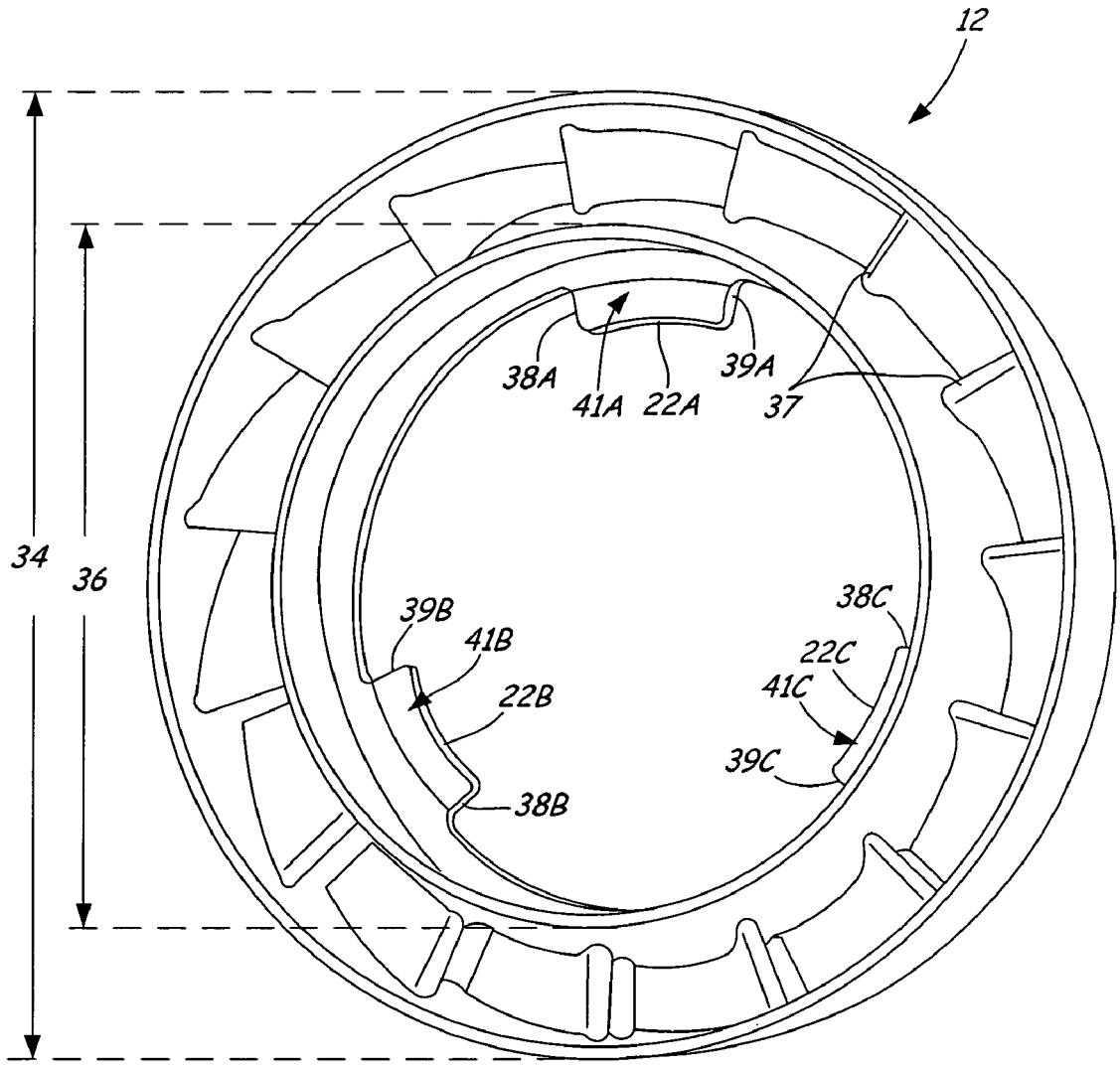
FIG. 3 is a perspective view of the ceramic vane ring of FIG. 2.

FIG. 3 is a perspective view of ceramic vane ring 12. As shown in FIG. 3, ceramic vane ring 12 is a circular member having outer diameter 34, inner diameter 36, a plurality of circumferentially spaced vane members 37, and multiple tab members 22A-22C. Each of tab members 22A-22C includes a first side 38 and a second side 39. Tab members 22A-22C may be manufactured as separate components that are later attached to an inner surface defined by inner diameter 36 of vane ring 12, or integrally formed as extensions of the inner surface itself. Furthermore, as shown in FIG. 3, tab members 22A-22C are spaced equally around the inner surface of vane ring 12, although tab members that are not equally spaced are also contemplated.

Although ceramic vane ring 12 is illustrated with three tab members 22A-22C, vane rings having any number of tab members are within the intended scope of the present invention. However, ceramic vane ring 12 preferably includes at least two tab members 22 to distribute the load created by combustion gases from the combustor over at least a couple of locations instead of having the entire load distributed at one location. In the embodiment shown in FIG. 3, the load is distributed between three equally spaced tab members 22A-22C.

As illustrated in FIG. 3, a thin layer of insulation 41 (labeled 41A-41C) is placed on an outer surface of each tab member 22A-22C. While insulation 41 is not a necessary component of the present invention, it acts as a barrier between ceramic vane ring 12 and spring members 24 and 26 of first and second clamping rings 14 and 16 and serves numerous functions. First, ceramic tab members such as tab members 22A-22C generally have a rough outer surface. When such a rough surface is contacted by, for example, a spring member, many pressure points arise along the outer surface of the tab member. As a result, areas of very high stress are created on the tab members. Insulation 41 functions to "smooth out" the outer surface of tab members 22A-22C in order to spread out the contact load evenly along the outer surface of ceramic tab members 22A-22C. Second, insulation 41 functions to reduce heat flow from ceramic vane ring 12 to first and second clamping rings 14 and 16. Third, insulation 41 functions to reduce the possibility of a chemical reaction between the ceramic material of ceramic vane ring 12 and the metal materials of first and second clamping rings 14 and 16.

In one embodiment, insulation 41 is formed from a Platinum foil having a thickness of approximately 4 mils. However, it should be understood that other types and thicknesses of material that serve the functions enumerated above may also be used without departing from the intended scope of the present invention. Also, the insulation may be applied only to the spring members 24 and 26, or in combination with the tab members 22A-22C.

Ceramic vane ring 12 may be formed from any ceramic material that is able to withstand the combustion gas temperature and conditions in a particular application. One such ceramic material capable of withstanding high thermal and oxidation conditions present in a high temperature combustion gas is silicon nitride.

Figure 4A:
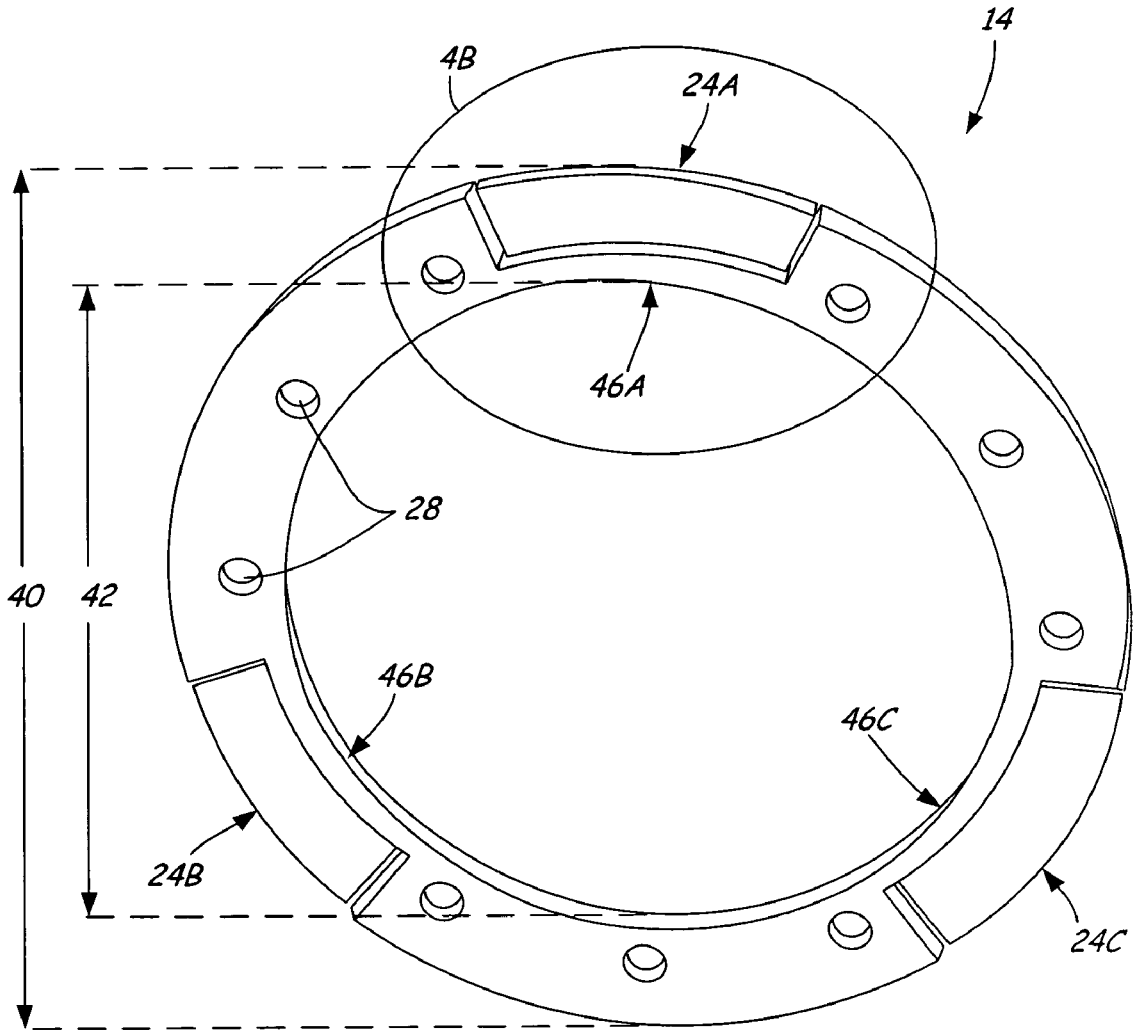
FIG. 4A is a perspective view of the first metal clamping ring of FIG. 2.

FIG. 4A is a perspective view of first metal clamping ring 14. As shown in FIG. 4A, first clamping ring 14 is a circular disc having outer diameter 40, inner diameter 42, a plurality of apertures 28, and a plurality of spring members 24A-24C. Outer diameter 42 of first metal clamping ring 14 is less than inner diameter 36 of ceramic vane ring 12, thus allowing first metal clamping ring 14 to nest inside of ceramic vane ring 12.

First clamping ring 14 is designed with three spring members 24A, 24B, and 24C such that each spring member is configured to mate with one of the three tab members 22A, 22B, and 22C of ceramic vane ring 12 when first metal clamping ring 14 is nested within ceramic vane ring 12. Each spring member 24A-24C includes an axial leaf spring 46A-46C configured to supply a pre-load axial force on an upstream side of tab members 22A-22C to provide axial support to ceramic vane ring 12.

Figure 4B:
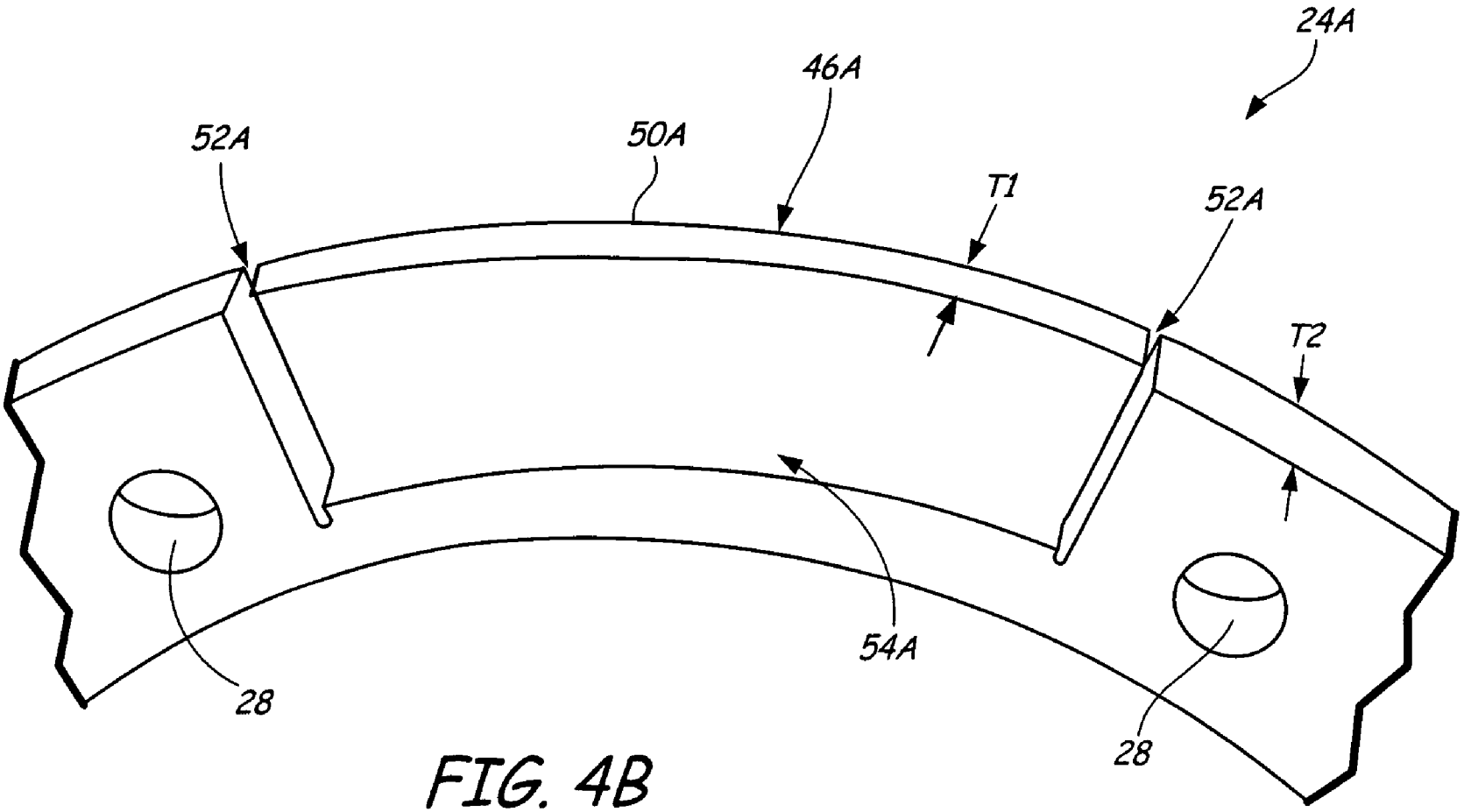
FIG. 4B is a diagram illustrating a portion of the first metal clamping ring.

FIG. 4B is a diagram illustrating an expanded section view 4B taken of first metal clamping ring 14 in FIG. 4A. As shown in FIG. 4B, axial leaf spring 46A includes flange 50A, a pair of gap portions 52A, and shoulder 54A. Due to the presence of gap portions 52A, flange 50A is connected to first clamping ring 14 along a single side, thus allowing flange 50A to flex in an axial direction. As shown in FIG. 4B, thickness T1 of flange 50A is less than thickness T2 of first clamping ring 14, thus creating shoulder 54A. While shoulder 54A is not a necessary component of the present invention, it increases the ability of flange 50A to flex in response to an axial load due to the decreased thickness T1 of flange 50A.

Figure 5A:
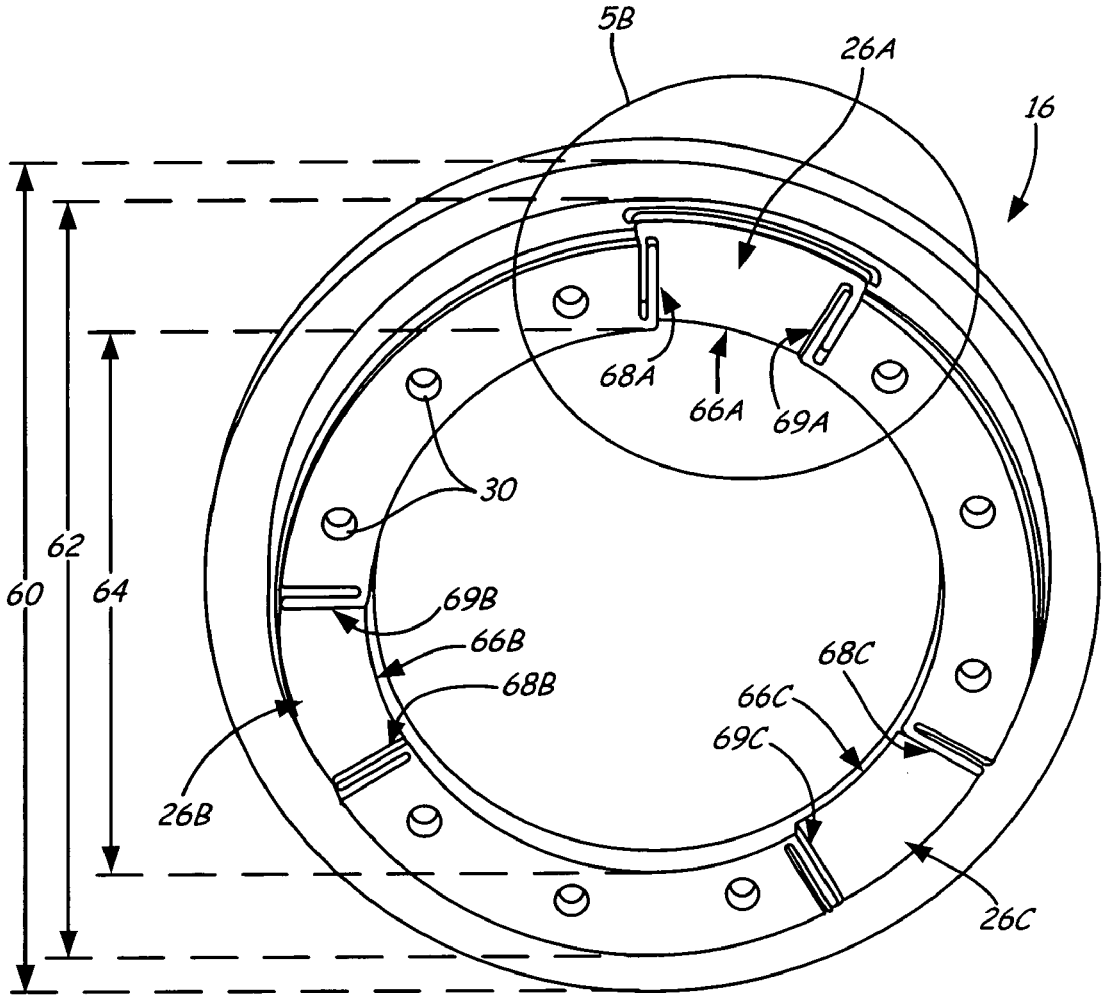
FIG. 5A is a perspective view of the second metal clamping ring of FIG. 2.

FIG. 5A is a perspective view of second metal clamping ring 16. As shown in FIG. 5A, second clamping ring 16 is also a generally circular disc having outer diameter 60, intermediate diameter 62, inner diameter 64, a plurality of apertures 30, and a plurality of spring members 26A-26C. Intermediate diameter 62 of first metal clamping ring 16 is less than inner diameter 36 of ceramic vane ring 12, thus allowing a portion of second metal clamping ring 16 to nest inside of ceramic vane ring 12.

Second clamping ring 16 is also designed with three spring members 26A, 26B, and 26C such that each spring member is configured to mate with one of the three tab members 22A, 22B, and 22C of ceramic vane ring 12 when second metal clamping ring 16 is nested within ceramic vane ring 12. Each spring member 26A-26C includes an axial leaf spring 66A-66C configured to supply a pre-load axial force on a downstream side of tab members 22A-22C to provide axial support to ceramic vane ring 12, as well as first and second side leaf springs 68A-68C and 69A-69C to supply a pre-load tangential force on first and second sides 38 and 39 of tab members 22. Thus, for example, when ceramic vane ring assembly 10 is fully assembled, axial leaf spring 46A provides an axial pre-load force on the upstream side U of tab member 22A, axial leaf spring 66A provides an axial pre-load force on the downstream side D, and first and second side leaf springs 68A and 69A provide a tangential pre-load force on first and second sides 38A and 39A of tab member 22A, respectively.

Figure 5B:
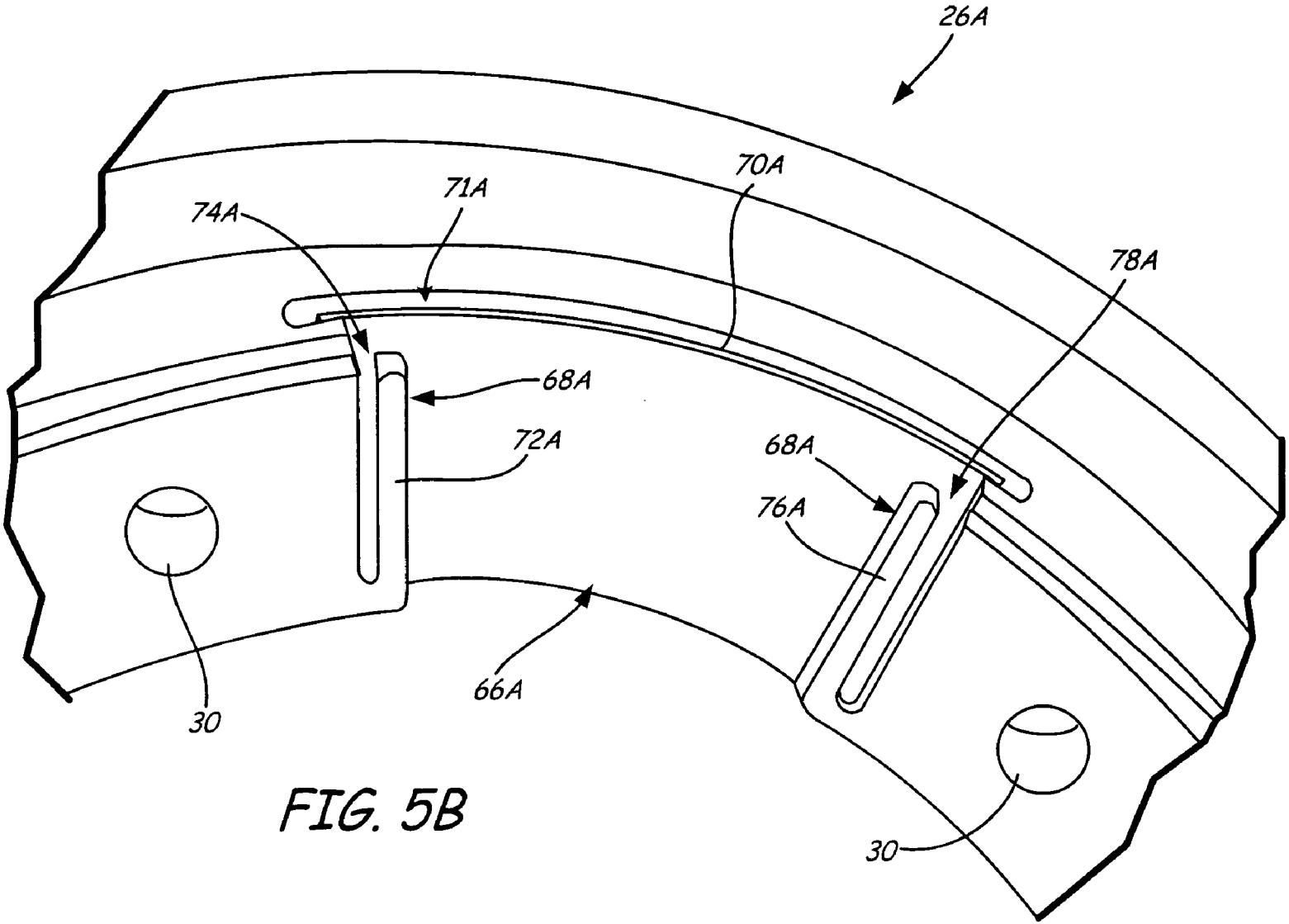
FIG. 5B is a diagram illustrating a portion of the second metal clamping ring.

FIG. 5B is a diagram illustrating an expanded section view 5B taken of second metal clamping ring 16 in FIG. 5A. As shown in FIG. 5B, axial leaf spring 66A includes flange 70A and axial leaf spring pocket 71A, first side leaf spring 68A includes flange 72A and first side leaf spring pocket 74A, and second side leaf spring 69A includes flange 76A and second side leaf spring pocket 78A. Axial leaf spring pocket 71A is configured to allow axial movement of flange 70A in response to, for example, growth of ceramic vane ring 12 and second clamping ring 16 due to thermal expansion. Similarly, first and second side leaf spring pockets 74A and 78A are configured to allow tangential movement of flanges 72A and 76A in response to thermal expansion of the components.

In one embodiment of ceramic vane ring assembly 10, first and second clamping rings 14 and 16 are manufactured from INCO-625. However, any metal or alloy capable of withstanding the conditions present in an aircraft engine assembly may be used in place of INCO-625.

Figure 6:
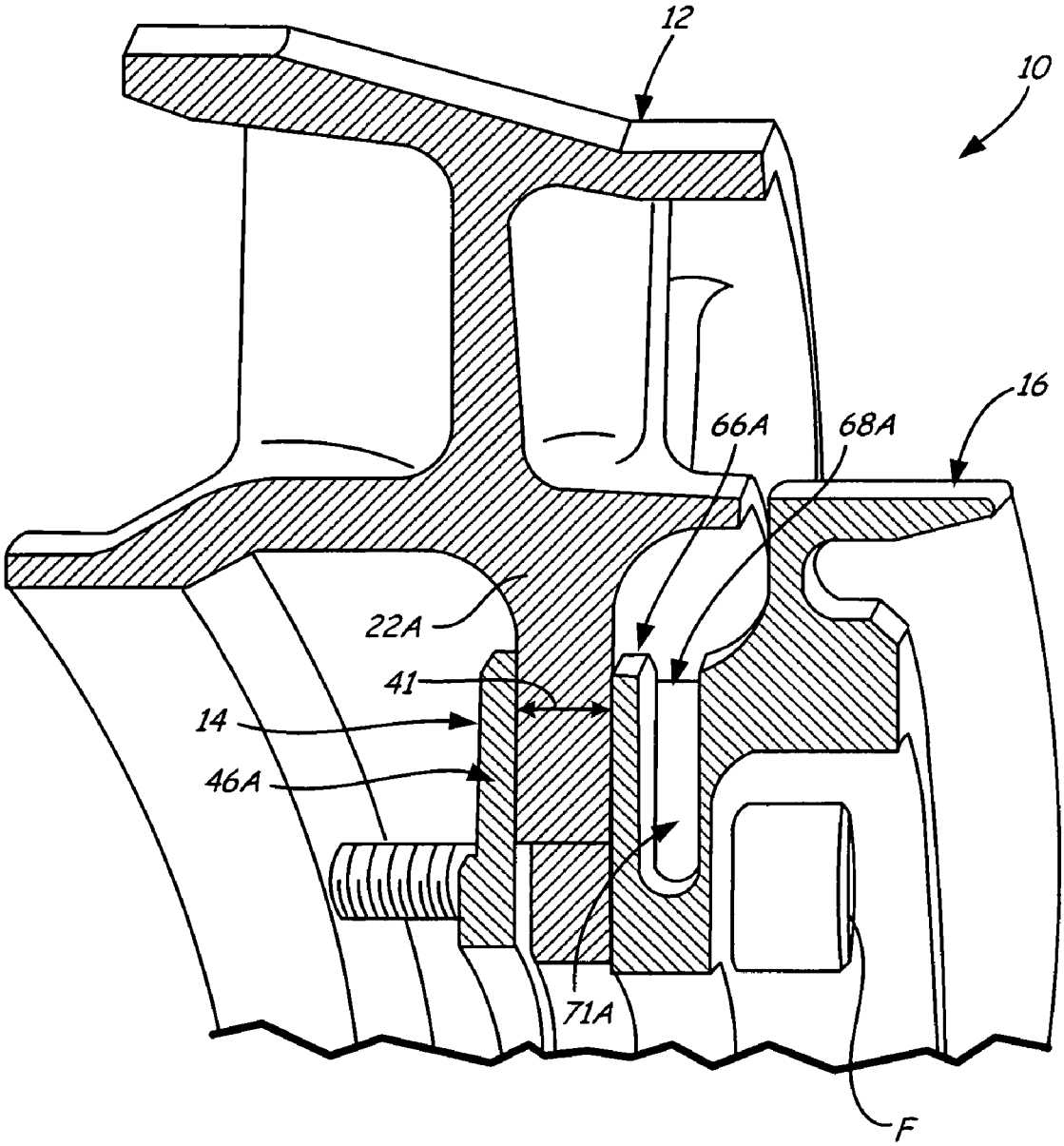
FIG. 6 is a cross-sectional assembled view of a portion of the ceramic vane ring assembly of FIG. 2.

FIG. 6 is a cross-sectional assembled view of a portion of ceramic vane ring assembly 10. As illustrated in FIG. 6, first clamping ring 14 and second clamping ring 16 are nested within inner diameter 36 of the ceramic vane ring 12 and secured together by a plurality of fasteners F (only one being shown). As a result, tab member 22A is "sandwiched" between axial leaf spring 46A of first clamping ring 14 and axial leaf spring 66A of second clamping ring 16 so that ceramic vane ring 12 is supported in an axial direction by first and second clamping rings 14 and 16. As shown in FIG. 6, insulation 41 is disposed between tab member 22A and axial leaf springs 46A and 66A and serves the functions previously enumerated in the discussion above in reference to FIG. 3. Although not visible in this cross-sectional view, ceramic vane ring 12 is also supported tangentially by second clamping ring 16 due to the clamping force provided on tab member 22A by first and second side leaf springs 68A and 69A.

As stated previously, axial leaf spring 46A of first clamping ring 14 and axial leaf spring 66A of second clamping ring 16 provide axial support of ceramic vane ring 12. Although the ceramic material of ceramic vane ring 12 will expand at a lower rate than the metal material of first and second clamping rings 14 and 16 due to different coefficients of thermal expansion (CTE), these differences in thermal expansion are accommodated by leaf spring deflection. Thus, leaf springs 46A and 66A are configured to "deform" during thermal expansion in order to minimize contact pressure between the springs and tab member 22A before a failure occurs, such as a fracture in ceramic vane ring 12.

Figure 7:
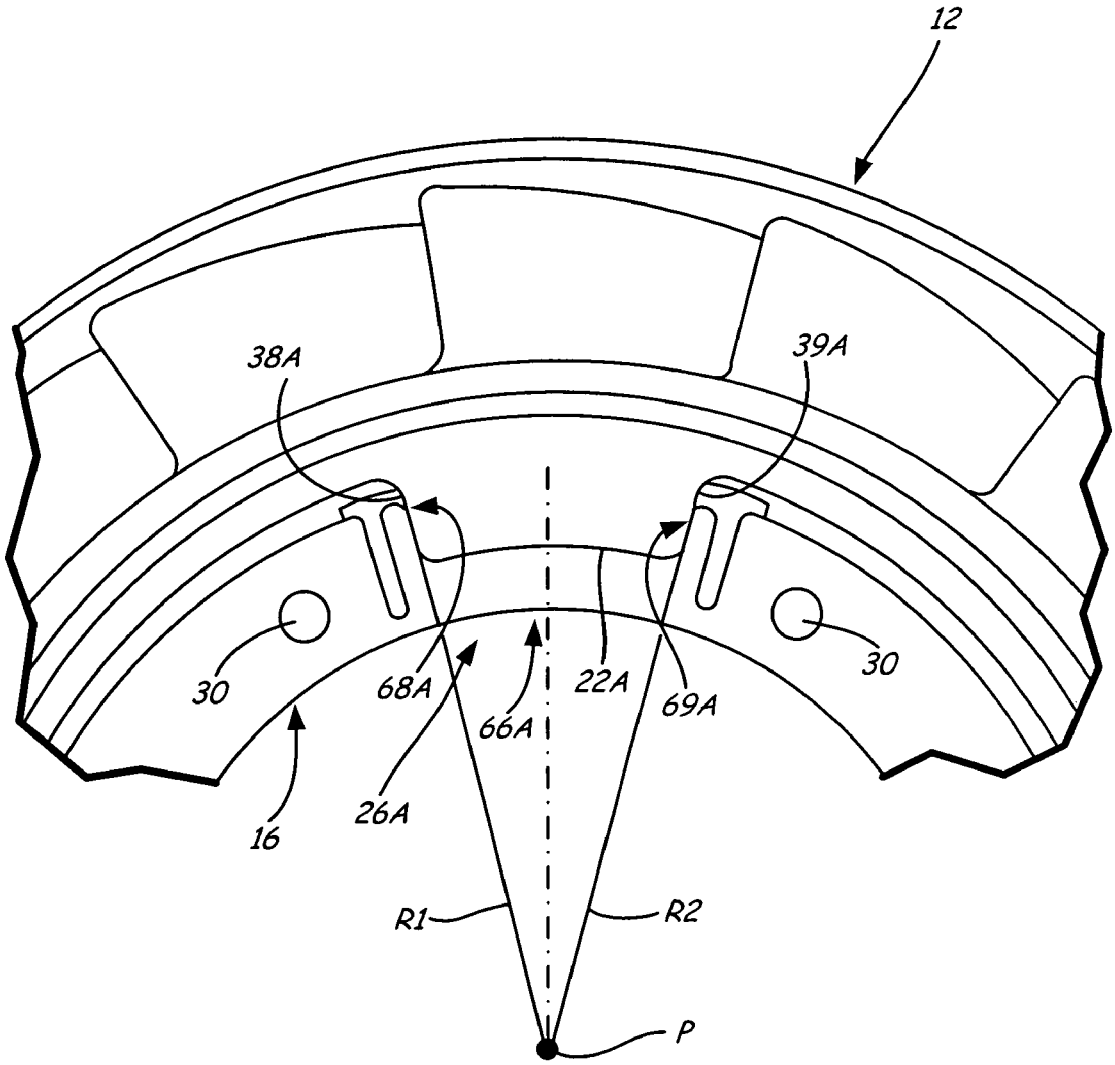
FIG. 7 is a diagram illustrating how a spring member of the second metal clamping ring interacts with a tab member of the ceramic vane ring to provide tangential support of the ceramic vane ring.

FIG. 7 is a view from the upstream side of ceramic vane ring 12 illustrating how first and second side leaf springs 68A and 69A interact with tab member 22A of ceramic vane ring 12. In FIG. 7, first side leaf spring 68A contacts first side 38A of tab member 22A, while second side leaf spring 69A contacts second side 39A of tab member 22A. As illustrated in FIG. 7, the contact areas between the side leaf springs and the sides of the tab member are in the same radial plane, as indicated by radial lines R1 and R2 which intersect at center point P of ceramic vane assembly 10. It is beneficial to have contact surfaces of the side leaf springs and tab members in the same radial planes to facilitate relative sliding during heat-up and cool-down cycles that coincide with engine start-up and shut-down. In particular, as ceramic vane ring 12 and second clamping ring 16 expand and contract during thermal cycling, ceramic vane ring 12 may grow radially less than second metal clamping ring 16. However, first and second sides 38A and 39A will remain in substantially the same radial planes as they did prior to the thermal cycling. Similarly, the contact surfaces of first and second side leaf springs 68A and 69A will remain in substantially the same radial planes as well. Such a deformation pattern keeps ceramic vane ring 12 concentric and minimizes the creation of thermal stresses on tab members 22A-22C.

Figure 8:
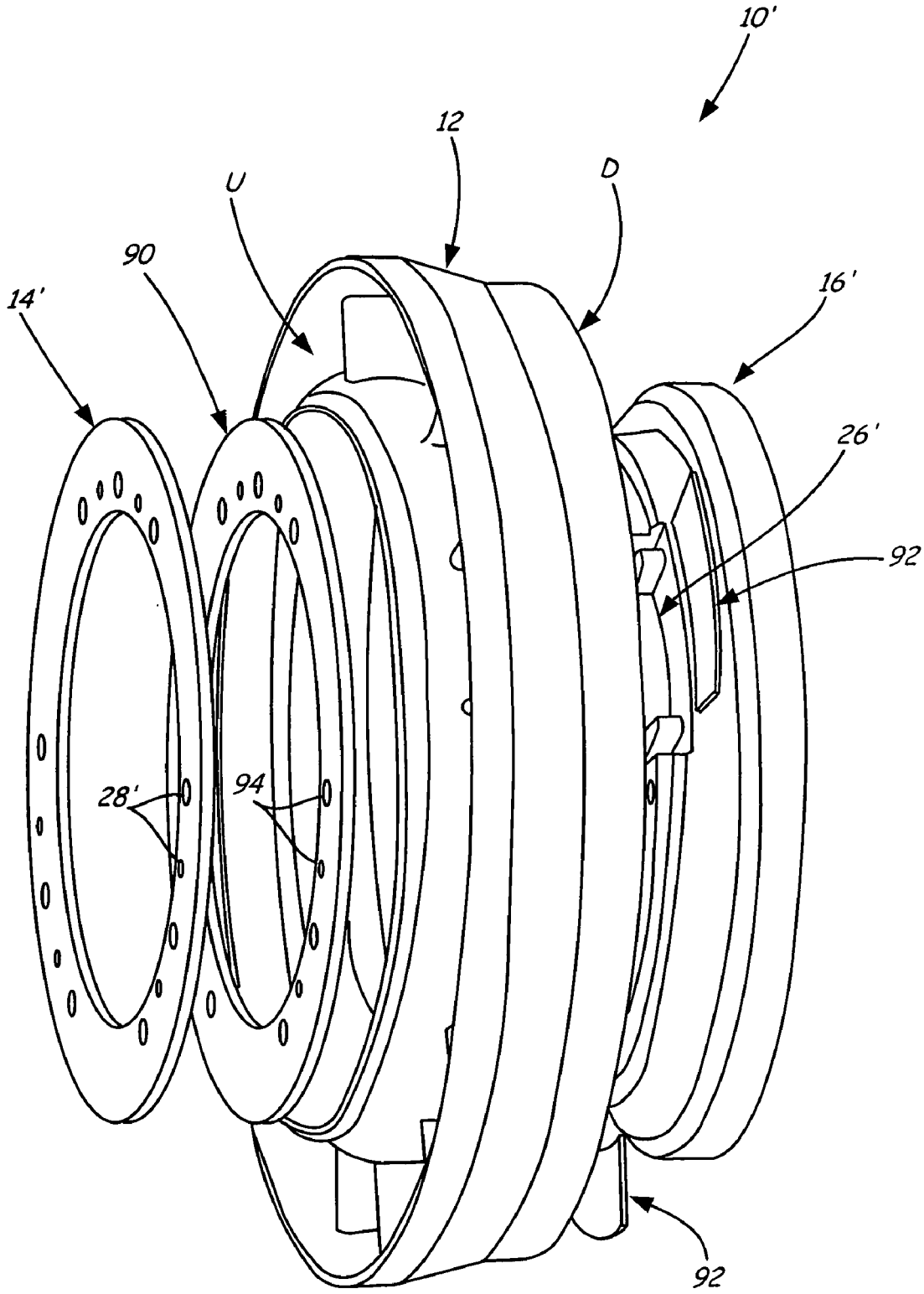
FIG. 8 is an exploded perspective view of a first alternative embodiment of a ceramic vane ring assembly, which includes a ceramic vane ring, a first metal clamping ring, and a second metal clamping ring.

FIG. 8 illustrates an exploded perspective view of ceramic vane ring assembly 10', which is one alternative embodiment of ceramic vane ring assembly 10 shown and described above in reference to FIGS. 1-7. Ceramic vane ring assembly 10' includes ceramic vane ring 12, first metal clamping ring 14', second metal clamping ring 16', first gasket 90, and second gasket 92. Similar to ceramic vane ring assembly 10 discussed above, first clamping ring 14' is configured to support an upstream side U of ceramic vane ring 12, while second clamping ring 16' is configured to support a downstream side D of ceramic vane ring 12.

As shown in FIG. 8, first clamping ring 14' differs from first clamping ring 14 in that spring members 24A-24C have been eliminated. Instead, a compliant ceramic gasket 90 is inserted between first metal clamping ring 14' and tab members 22A-22C. Second clamping ring 16' differs from second clamping ring 16 in that the axial leaf spring components 66A-66C of spring members 26A-26C are replaced by a second gasket 92. In particular, gasket 92 comprises three distinct portions, with one portion inserted in between the downstream side of each tab member and a corresponding spring member 26'.

Gasket 90 is sized similar to first clamping ring 14' and includes a plurality of apertures 94 configured to align with apertures 28' in first clamping ring 14' to receive a plurality of fasteners. Gasket 90 is preferably formed from a ceramic gasket material that may be compressed between first clamping ring 14' and tab members 22A-22C to provide a pre-load force on the tab members as well as to accommodate thermal expansion of ceramic vane ring 12 and first clamping ring 14'. Similarly, gasket 92 is preferably formed from a similar ceramic gasket material that may be compressed between spring members 26' of second clamping ring 16' and tab members 22A-22C to provide a pre-load force on the tab members as well as to accommodate thermal expansion of ceramic vane ring 12 and second clamping ring 16'.

Ceramic gaskets 90 and 92 not only serve to pre-load tab members 22A-22C and accommodate thermal expansion as discussed above, but they also serve as an insulation means similar to insulation 41 described in FIG. 3. In particular, ceramic gaskets 90 and 92 function to reduce heat flow from ceramic vane ring 12 to first and second clamping rings 14' and 16', eliminate any chemical reaction between the ceramic and metal materials, and spread the contact load evenly on ceramic tab members 22A-22C.

Figure 9:
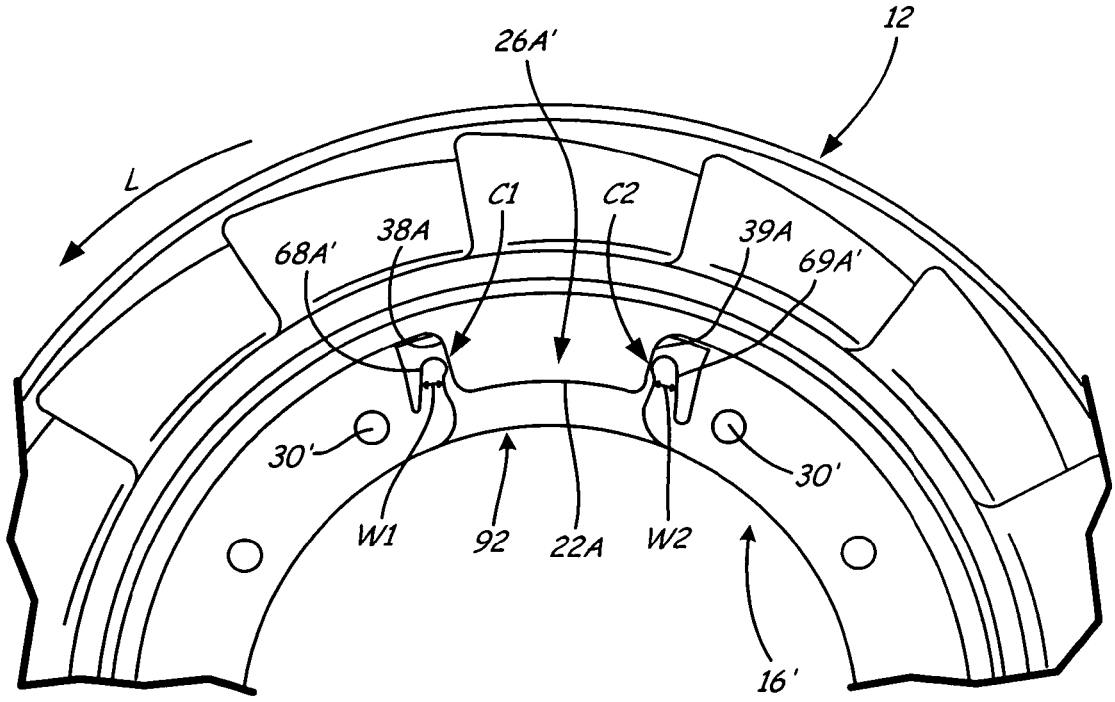
FIG. 9 is a diagram illustrating a spring member of the second metal clamping ring engaging with a tab member of the ceramic vane ring.

FIG. 9 is a view form the upstream side of ceramic vane ring 12 illustrating how spring member 26A' of second clamping ring 16' provides a tangential pre-load force on tab member 22A. As shown in FIG. 9, spring member 26A' includes first side leaf spring 68A' and second side leaf spring 69A' configured to provide a pre-load tangential force on first and second sides 38A and 39A of tab member 22A, respectively. In FIG. 9, gasket portion 92 is disposed between tab member 22A and second metal clamping ring 16' in order to provide the benefits discussed above in reference to FIG. 8.

During operation of a gas turbine engine, the turning of combustion gas within the engine generates a tangential load that will push a vane ring preferentially toward one tangential direction. This additional tangential load is represented in FIG. 9 by arrow L, which indicates that the tangential load resulting from the combustion gas tends to push ceramic vane ring 12 toward the left. In order to handle this increased load, first side leaf spring 68A' is designed with a width W1 that is greater than width W2 of second side leaf spring 69A'. It should be noted that the required widths W1 and W2 will depend upon the magnitude of the tangential force experienced by the vane ring. In addition, first and second side leaf springs 68A' and 69A' should be sized in such a way that a sufficient clamp load on tab member 22A is maintained at both room and operating temperatures. Furthermore, the front surface of first and second leaf springs 68A' and 69A' is preferably recessed slightly such that the leaf springs are not clamped directly against tab member 22A to enable the leaf springs to deform under tangential loading.

As illustrated in FIG. 9, first side leaf spring 68A' has a crowned tip portion C1 that contacts first side 38A of tab member 22A. Similarly, second side leaf spring 69A' has a crowned tip portion C2 that contacts second side 39A of tab member 22A. Crowned tip portions C1 and C2 create a well defined contact area at the tab member root, thereby helping to reduce bending stress and assist sliding of tab member 22A relative to first and second side leaf springs 68A' and 69A'. In addition, it may be beneficial to design first and second side leaf springs 68A' and 69A' so that only crowned tip portions C1 and C2 are in contact with tab member 22A since the closer a contact point is to the tips of leaf springs 68A' and 69A', the less stiff the springs will be and, as a result, less force will be placed upon tab member 22A.

Although the present invention has been described with reference to preferred embodiments, workers skilled in the art will recognize that changes may be made in form and detail without departing from the spirit and scope of the invention.

The invention claimed is:

1. An assembly for mounting a ceramic turbine vane ring onto a turbine support casing, the assembly comprising:

a first metal clamping ring configured to engage with a first side of a tab member of the ceramic turbine vane ring; and a second metal clamping ring configured to engage with a second side of the tab member such that the tab member is disposed between the first and second metal clamping rings, and wherein the second metal clamping ring includes a spring member for engaging with the second side of the tab member.

2. The assembly of claim 1, wherein the spring member of the second metal clamping ring comprises an axial leaf spring.

3. The assembly of claim 2, wherein the spring member of the second metal clamping ring further comprises a pair of side leaf springs for engaging with the tab member of the ceramic turbine vane ring.

4. The assembly of claim 3, wherein the first metal clamping ring includes a spring member for mating with the first side of the tab member.

5. The assembly of claim 4, wherein the spring member of the first metal clamping ring comprises an axial leaf spring.

6. The assembly of claim 1, wherein the tab member extends radially inward from an inner surface of the ceramic turbine vane ring.

7. The assembly of claim 1, wherein the ceramic turbine vane ring comprises a plurality of tab members, and wherein the first and second metal clamping rings each include a plurality of spring members equal to the number of tab members for engaging with a respective one of the tab members.

8. The assembly of claim 7, wherein the spring members of the first metal clamping ring comprise an axial leaf spring.

9. The assembly of claim 8, wherein the spring members of the second metal clamping ring comprise an axial leaf spring and a pair of side leaf springs.

10. The assembly of claim 9, and further comprising an insulation layer disposed between the axial leaf springs of the first and second metal clamping rings and their respective tab members.

11. The assembly of claim 1, and further comprising:

a first gasket positionable between the first metal clamping ring and a first side of the ceramic turbine vane ring; and a second gasket positionable between the second metal clamping ring and a second side of the ceramic turbine vane ring.

12. The assembly of claim 11, wherein the second metal clamping ring further comprises a spring member comprising a pair of side leaf springs configured to generate a clamping force on the tab member.

13. The assembly of claim 12, wherein one of the pair of side leaf springs has a stiffness greater than that of the other side leaf spring for supporting an increased tangential load caused by combustion gases.

14. The assembly of claim 12, wherein at least one of the side leaf springs includes a crowned tip portion for contacting the tab member.

15. A turbine vane ring assembly comprising:

a ceramic vane ring having a plurality of tab members;

a first metal clamping ring configured to engage with a first side of the tab members; and a second metal clamping ring having a plurality of spring members, wherein the spring members are configured to engage with the tab members to provide support to the ceramic vane ring.

16. The turbine vane ring assembly of claim 15, wherein the spring members of the second metal clamping ring each comprise an axial leaf spring for providing axial support to the ceramic vane ring and a pair of side leaf springs for providing tangential support to the ceramic vane ring.

17. The turbine vane ring assembly of claim 16, wherein at least one of the side leaf springs includes a crowned tip portion.

18. The turbine vane ring assembly of claim 15, wherein the first metal clamping ring includes a plurality of spring members for engaging with the tab members of the ceramic vane ring to provide axial support to the ceramic vane ring.

19. An assembly for mounting onto a turbine support casing a ceramic turbine vane ring having a plurality of tab members, the assembly comprising:

a first metal clamping ring for supporting an upstream side of the ceramic vane ring and having a plurality of spring members configured to engage with the tab members to minimize thermal stress arising from differences in thermal growth between the ceramic turbine vane ring and the first metal clamping ring; and a second metal clamping ring for supporting a downstream side of the ceramic vane ring and having a plurality of spring members configured to engage with the tab members to minimize thermal stress arising from differences in thermal growth between the ceramic turbine vane ring and the second metal clamping ring.

20. The assembly of claim 19, wherein the spring members of the first metal clamping ring comprise an axial leaf spring.

21. The assembly of claim 19, wherein the spring members of the second metal clamping ring comprise an axial leaf spring and a pair of side leaf springs.

22. The assembly of claim 21, wherein at least one of the side leaf springs includes a crowned tip portion.

* * * * *